US012123281B2

(12) United States Patent
McCarthy et al.

(10) Patent No.: US 12,123,281 B2
(45) Date of Patent: Oct. 22, 2024

(54) BARRIER MEMBER

(71) Applicant: TORSCH INC., Calgary (CA)

(72) Inventors: Matthew McCarthy, Calgary (CA); Steven Taitinger, Calgary (CA)

( * ) Notice: Subject to any disclaimer, the term of this patent is extended or adjusted under 35 U.S.C. 154(b) by 0 days.

(21) Appl. No.: 17/698,597

(22) Filed: Mar. 18, 2022

(65) Prior Publication Data

US 2023/0295999 A1 Sep. 21, 2023

(51) Int. Cl.
*E21B 34/06* (2006.01)
*E21B 33/12* (2006.01)

(52) U.S. Cl.
CPC ..... *E21B 34/063* (2013.01); *E21B 33/12* (2013.01)

(58) Field of Classification Search
CPC ..... E21B 34/063; E21B 33/12
See application file for complete search history.

(56) References Cited

U.S. PATENT DOCUMENTS

| | | | | |
|---|---|---|---|---|
| 244,042 | A | | 7/1881 | Farrar |
| 2,149,659 | A | | 3/1939 | Johnston |
| 3,779,263 | A | | 12/1973 | Edwards et al. |
| 3,831,680 | A | | 8/1974 | Edwards |
| 5,865,254 | A | | 2/1999 | Huber |
| 5,924,696 | A | | 7/1999 | Frazier |
| 5,979,561 | A | | 11/1999 | Edwards |
| 6,076,600 | A | * | 6/2000 | Vick, Jr. ..... E21B 33/1208 166/376 |
| 6,186,227 | B1 | | 2/2001 | Vaynshteyn |
| 6,550,551 | B2 | | 4/2003 | Brunnert |
| 6,672,389 | B1 | | 1/2004 | Hinrichs |
| 7,963,340 | B2 | | 6/2011 | Gramstad et al. |
| 9,217,319 | B2 | | 12/2015 | Frazier |
| 9,291,031 | B2 | | 3/2016 | Frazier |
| 9,382,778 | B2 | | 7/2016 | Frazier |
| 9,441,437 | B2 | | 9/2016 | Fripp et al. |
| 9,441,446 | B2 | | 9/2016 | Fripp et al. |
| 9,464,748 | B2 | | 10/2016 | Ewing et al. |
| 9,518,440 | B2 | | 12/2016 | Sanchez et al. |
| 9,540,904 | B2 | | 1/2017 | Petrowsky |
| 9,677,391 | B2 | | 6/2017 | Banks et al. |
| 9,752,423 | B2 | | 9/2017 | Lynk |
| 9,816,350 | B2 | | 11/2017 | Mailand |
| 9,885,224 | B2 | | 2/2018 | Tough et al. |
| 9,932,791 | B2 | | 4/2018 | Walton |
| 10,060,213 | B2 | | 8/2018 | Maenza |
| 10,107,070 | B2 | | 10/2018 | Yong et al. |

(Continued)

FOREIGN PATENT DOCUMENTS

| | | |
|---|---|---|
| CA | 3127060 | 7/2020 |
| CA | 3134409 | 8/2020 |

(Continued)

*Primary Examiner* — Catherine Loikith
(74) *Attorney, Agent, or Firm* — Richard D. Okimaw

(57) ABSTRACT

An apparatus for selectably sealing an interior bore of a completion string comprises an elongate body and has connectors for connecting the body in line with a completion string. An interior wall of the apparatus forms a bore through the elongate body. A rupturable barrier member fastened to and bridging the bore is deformable so as to permit passage therepast after being ruptured. The barrier member includes at a weakened path defining a leaf extending from a hinge portion narrower than the widest portion of the leaf.

27 Claims, 12 Drawing Sheets

(56) References Cited

U.S. PATENT DOCUMENTS

| | | | |
|---|---|---|---|
| 10,208,564 | B2 | 2/2019 | Ravensbergen et al. |
| 10,221,669 | B2 | 3/2019 | Tolman |
| 10,267,111 | B2 | 4/2019 | Hart |
| 10,316,979 | B2 | 6/2019 | Petrowsky |
| 10,337,285 | B2 | 7/2019 | Kellner |
| 10,465,468 | B2 | 11/2019 | Frazier et al. |
| 10,472,925 | B2 | 11/2019 | Hiorth et al. |
| 10,519,753 | B2 | 12/2019 | Dedman |
| 10,538,991 | B2 | 1/2020 | Hofman et al. |
| 10,544,654 | B2 | 1/2020 | Bjørgum et al. |
| 10,550,654 | B2 | 2/2020 | Jaaskelainen |
| 10,577,890 | B2 | 3/2020 | Nordheimer |
| 10,584,557 | B2 | 3/2020 | Roessler et al. |
| 10,677,012 | B2 | 6/2020 | Oag |
| 10,683,728 | B2 | 6/2020 | Kellner et al. |
| 10,781,658 | B1 | 9/2020 | Kumar et al. |
| 10,781,661 | B2 | 9/2020 | Tanguy |
| 10,787,884 | B2 | 9/2020 | Brandsdal |
| 10,808,489 | B2 | 10/2020 | Hiorth |
| 10,808,490 | B2 | 10/2020 | Giroux |
| 10,815,747 | B2 | 10/2020 | Petrowsky |
| 10,858,906 | B2 | 12/2020 | Saraya |
| 10,883,315 | B2 | 1/2021 | Getzlaf et al. |
| 10,934,802 | B2 | 3/2021 | Brandsdal |
| 10,989,013 | B1 | 4/2021 | Helms |
| 10,995,583 | B1 | 5/2021 | Helms et al. |
| 11,047,186 | B2 | 6/2021 | Ng et al. |
| 11,072,990 | B2 | 7/2021 | Yuan et al. |
| 11,085,267 | B2 | 8/2021 | Saraya et al. |
| 11,098,556 | B2 | 8/2021 | Frazier |
| 11,105,166 | B2 | 8/2021 | Yuan et al. |
| 11,142,994 | B2 | 10/2021 | Yuan |
| 11,149,522 | B2 | 10/2021 | Brandsdal |
| 11,230,905 | B2 | 1/2022 | Helms et al. |
| 2011/0056679 | A1 | 3/2011 | Rytlewski |
| 2014/0083716 | A1 | 3/2014 | Frazier |
| 2017/0370182 | A1 | 12/2017 | Provost |
| 2018/0313183 | A1 | 11/2018 | Hiorth |
| 2019/0128099 | A1 | 5/2019 | Woudwijk |
| 2019/0234180 | A1 | 8/2019 | Frazier et al. |
| 2019/0292862 | A1 | 9/2019 | Obrien et al. |
| 2020/0009666 | A1 | 1/2020 | Krebill et al. |
| 2020/0115989 | A1 | 4/2020 | Hiorth |
| 2020/0131884 | A1 | 4/2020 | Saraya |
| 2020/0240214 | A1 | 7/2020 | Getzlaf et al. |
| 2021/0040811 | A1 | 2/2021 | Saraya et al. |
| 2021/0047895 | A1 | 2/2021 | Sherman |
| 2021/0131221 | A1 | 5/2021 | Helms et al. |
| 2021/0140255 | A1 | 5/2021 | Greci |
| 2021/0164307 | A1 | 6/2021 | Hicks et al. |
| 2021/0230970 | A1 | 7/2021 | Yuan et al. |
| 2021/0301596 | A1 | 9/2021 | Schultz |
| 2021/0340839 | A1 | 11/2021 | Tedjani |
| 2021/0363843 | A1 | 11/2021 | Stephenson et al. |
| 2021/0363858 | A1 | 11/2021 | Yuan |
| 2021/0372217 | A1 | 12/2021 | Lende et al. |
| 2021/0372223 | A1 | 12/2021 | Helms et al. |

FOREIGN PATENT DOCUMENTS

| | | | | |
|---|---|---|---|---|
| CN | 112709549 | | 4/2021 | |
| CN | 113187437 | | 7/2021 | |
| EP | 0750715 | | 1/1997 | |
| EP | 2984278 | | 2/2016 | |
| EP | 3094810 | | 11/2016 | |
| EP | 3191682 | | 10/2019 | |
| GB | 2308138 | A * | 6/1997 | ..... E21B 23/01 |
| GB | 2330164 | | 4/1999 | |
| GB | 2576042 | | 2/2020 | |
| GB | 2584260 | | 11/2020 | |
| WO | 03052239 | | 6/2003 | |
| WO | 2014053062 | | 4/2014 | |
| WO | 2014100141 | | 6/2014 | |
| WO | 2020223815 | | 11/2020 | |
| WO | 2021255058 | | 12/2021 | |

* cited by examiner

BARRIER MEMBER

BACKGROUND

1. Technical Field

This disclosure relates generally to petroleum extraction and in particular to a method and apparatus for forming and rupturing a deformable barrier member in a down hole string.

2. Description of Related Art

In down hole petroleum exploration and development, it is commonly desirable to provide a seal at a portion of the tool or work string. Such seals allow the isolation of a work zone for one or more processes and also prevent the inclusion of liquids and other materials into the work string as it is passed into the well bore. A further purpose of providing a seal in a completion string is to seal a quantity of air below the seal so as to provide buoyancy to the completion string when it is passed through or along a horizontal section of the well bore.

Common methods of providing such seal have been unsatisfactory. In particular, one common method of floating the completion string is to provide an upwardly extending dome of a fracturable material in the string. Such a dome is retained in place until a predetermined pressure above the dome is reached. At the predetermined pressure, the dome is permitted to shift downward into a reduced diameter section which compresses and thereby causes it to rupture. Disadvantageously, the fragments of the ruptured dome will then pass down the string which may interfere with the operation of the down string tools. Therefore a debris trap is commonly included in the string to catch these fragments. However, this debris trap still requires extra length and complexity in the overall string.

SUMMARY OF THE DISCLOSURE

According to a first embodiment, there is disclosed an apparatus for selectably sealing an interior bore of a down hole string comprising an elongate body extending between top and bottom ends having connectors for connecting the body in line with the completion string, an interior wall forming a bore through the elongate body between top and bottom ends and a rupturable barrier member fastened to and bridging the bore, the barrier member being deformable so as to permit passage therepast after being ruptured.

The barrier member may be ruptured by exceeding a predetermined pressure within the elongate body at a location above the barrier member. The barrier member may include a securing portion connectable to the elongate body and a bridging portion extending therefrom operable to enclose the bore in an initial configuration. The bridging portion may comprise a dome-shaped member.

The dome-shaped member may have a constant radius. The dome-shaped member may have a variable radius. The bridging portion may include at least one weakened path defining at least one leaf portion operable to be separated from the remainder of the barrier member along the weakened path. The at least one weakened path may comprise a path along the bridging portion thinner than a remainder thereof.

The at least one leaf portion may be connected to the base portion along a hinged portion. The at least one leaf portion may be deformable so as to be operable to be deformed to a shape corresponding to the bore. The at least one leaf portion may comprise a plurality of leaf portions. The barrier member may be oriented concavely downward.

The apparatus may further may include a slidable sleeve extending between first and second ends located within the bore upstream of the barrier member. The slidable sleeve may be biased towards the dome by a pressure within the bore. The slidable sleeve may be adapted to initiate the rupture of the barrier member at a downward location of movement thereof. The slidable sleeve may be retained at an initial position by a shearable member until a predetermined pressure is applied to the bore. The slidable sleeve may be radially oriented within the elongate body to engage the barrier member at a location thereon selected to correspond to an initial rupture location of the barrier member.

The first end of the sleeve may form a piston operable to be biased towards the second end under pressure within the bore. The sleeve may form an annular cavity with the elongate body proximate to the first end. The annular cavity may contain a fluid at atmospheric pressure at an initial or run in condition. The slidable sleeve may form a void with the sleeve downstream of the barrier member sized to retain the deformed portion of the barrier member after rupturing thereof.

The slidable sleeve may include a selectably engagable retaining member to engage a shoulder in the bore so as to retain the slidable sleeve at a position containing the at least one leaf in the void. The selectably engagable retaining member may comprise a snap ring.

The second end slidable sleeve may include an angled leading edge to a lead portion. The leading edge may be opposite to a hinge portion of the barrier member. The second end may be sharpened. The lead portion may be aligned with a weakened portion of path in the barrier member. The thickness of the weakened path may be selected to prevent the leading edge from penetrating therethrough until a predetermined pressure has been introduced to the bore. The slidable sleeve may include a longitudinal bore therethrough having a diameter corresponding substantially to the bore in the elongate body up and downstream of the slidable sleeve.

According to a further embodiment, there is disclosed a method for selectably sealing an interior bore of a down hole string comprising locating an elongate body extending between top and bottom ends in line with the completion string and applying a pressure to a bore through the completion string and body so as to rupture a barrier member fastened to and bridging the bore into at least one leaf portion wherein the at least one leaf portion is deformed out of the path of the bore.

Other aspects and features of the present disclosure will become apparent to those ordinarily skilled in the art upon review of the following description of specific embodiments in conjunction with the accompanying figures.

BRIEF DESCRIPTION OF THE DRAWINGS

The accompanying drawings constitute part of the disclosure. Each drawing illustrates exemplary aspects wherein similar characters of reference denote corresponding parts in each view.

DETAILED DESCRIPTION

Figure 1:
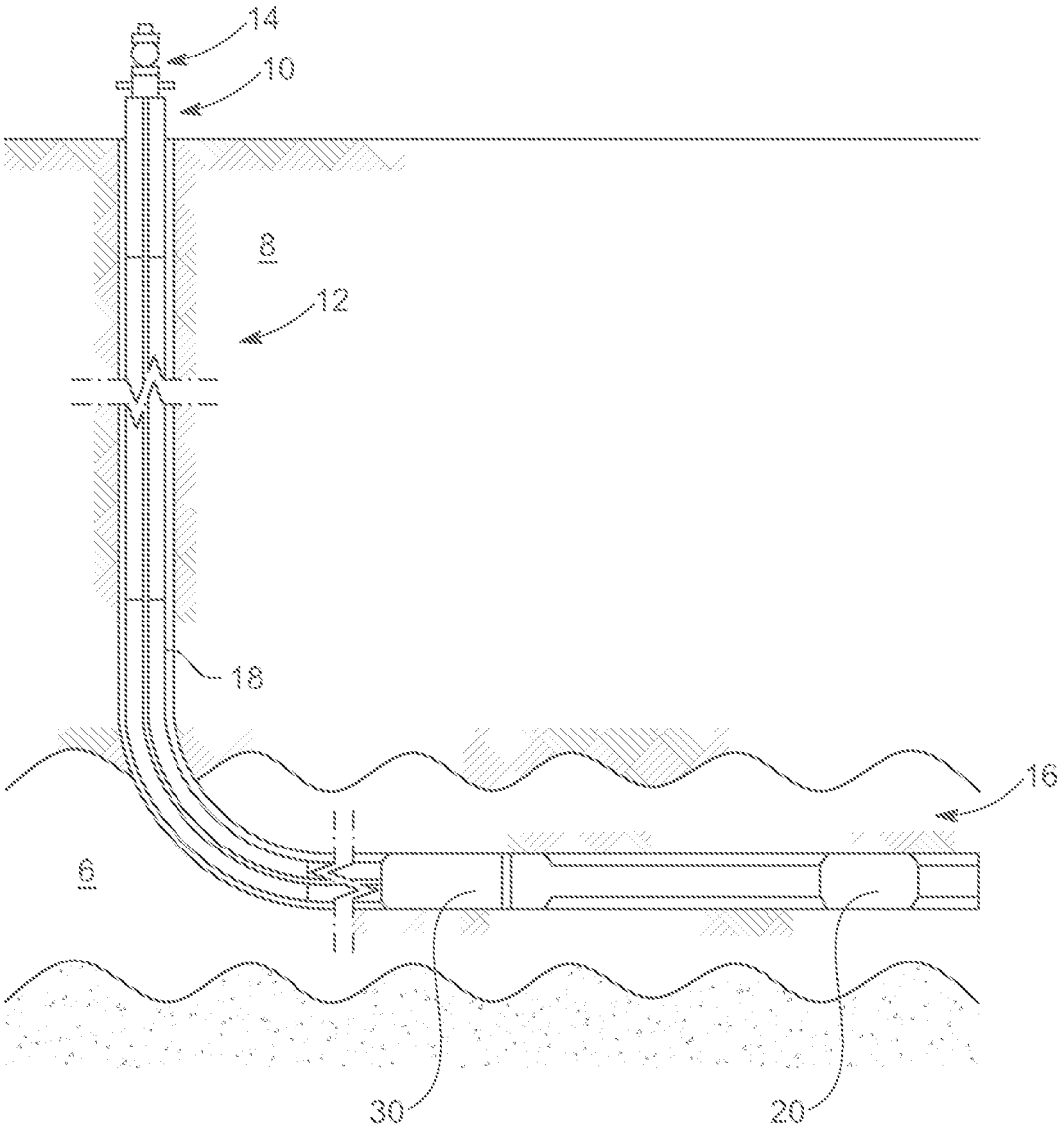
FIG. 1 is a side view of a completion string within a well bore having an apparatus for providing a buoyant force thereto according to a first embodiment of the present disclosure.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be vertical, horizontal or angularly oriented relative to the horizontal located within the production zone 6. After the wellbore 10 is drilled, a completion or other commonly utilized down hole string 18 is located therein which may optionally have one or more tools 20 therealong. As illustrated in FIG. 1, the tools 20 may be located at a bottom end of the completion string although it will be appreciated that they may be located at any other location as well. The completion string includes an apparatus 30 for providing floatation or sealing at a position upstream of the completion string.

Figure 2:
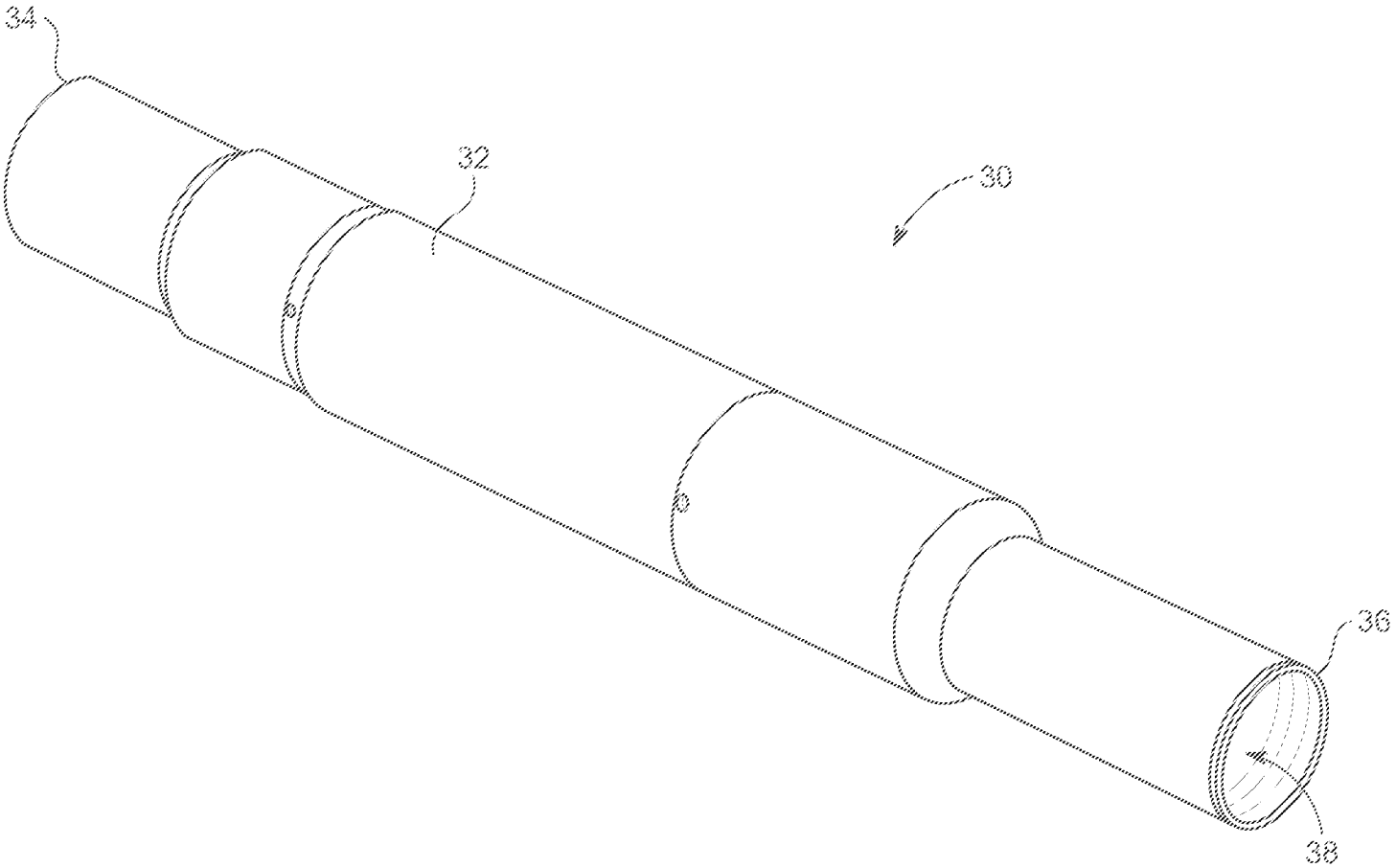
FIG. 2 is a perspective view of the apparatus for providing buoyant force to the completion string of FIG. 1.
Figure 3:
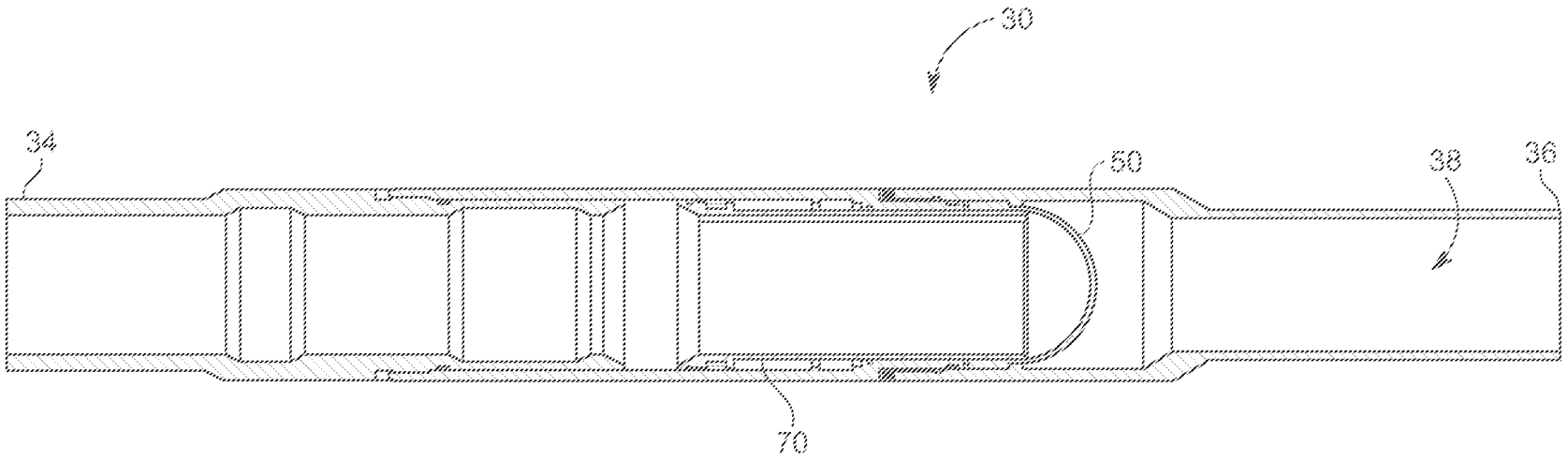
FIG. 3 is a cross sectional view of the apparatus of FIG. 2 as taken along the length of the apparatus at an initial configuration.

Turning now to FIGS. 2 and 3, the apparatus includes a casing 32 having a barrier member 50 and an optional slidable sleeve 70 therein. The barrier member 50 is adapted to form a seal across an central bore 38 of the casing so as to retain a fluid thereabove within the completion string 18. The barrier member 50 may also retain a portion of air or a lighter fluid below the barrier member 50 so as to provide a buoyant force to the completion string in horizontal sections of the wellbore 10. Upon application of a predetermined pressure, the barrier member 50 will cut, or otherwise separate the barrier member into segments, along one or more weakened path in the dome as will be more fully described below.

The casing 32 extends between top and bottom ends, 34 and 36, respectively and forms a central bore 38 therethrough. Each of the top and bottom ends 34 and 36 may include interior or external threading for connection in line with the completion string as is commonly known. Optionally, any other connection means as are known to the completion string may also be utilized. As illustrated in FIG. 3, the casing 32 may be formed of one or more sections coupled together by any commonly known means including fasteners, welding, threading or the like.

Figure 4:
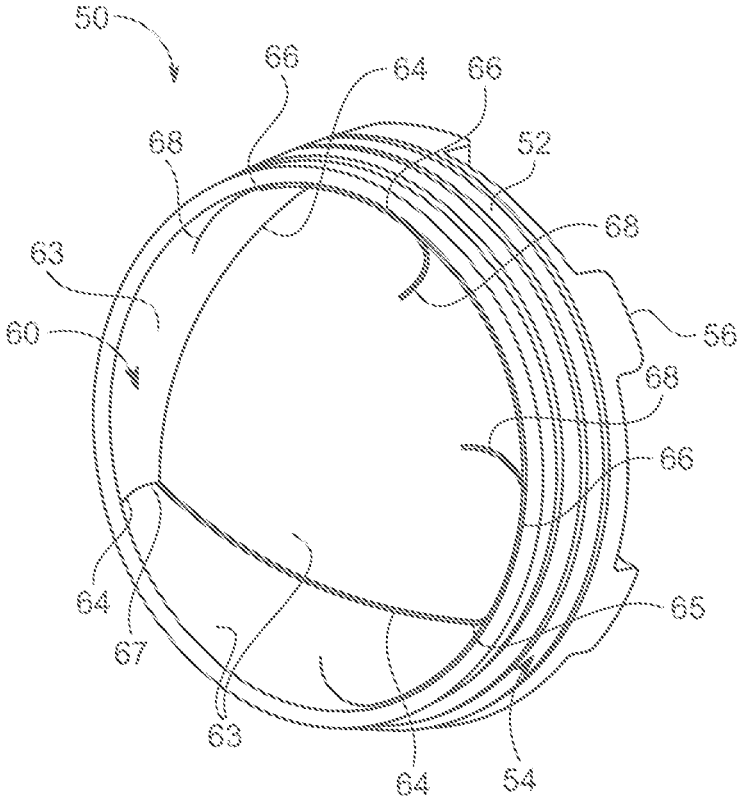
FIG. 4 is an end perspective view of the dome of FIG. 2 at an initial configuration.

Turning now to FIG. 4, a perspective view of the barrier member 50 is illustrated. The barrier member 50 includes an outer base ring 52 and a semi-dome portion 60 extending therefrom. Although, the dome portion 60 is illustrated as a semi-circular body in FIG. 4, it will be appreciated that other shapes and configurations may be utilized as well in which the body, after rupture, as described below will form portions adapted to lie against or proximate to the interior surface of the bore 38. The base ring 52 includes a retaining surface 54 oriented perpendicular to an axis of the apparatus 30. The retaining surface 54 bears against a ridge 39 on the inside of the casing 32 as illustrated in FIG. 3 so as to prevent downward movement of the barrier member. Optionally, the base ring 52 may include one or more lugs or protrusions 56 extending substantially in a longitudinally upward therefrom. The protrusions 56 are adapted to engage upon a corresponding protrusion (not shown) in the casing 32 to prevent unwanted rotation thereof.

Figure 5:
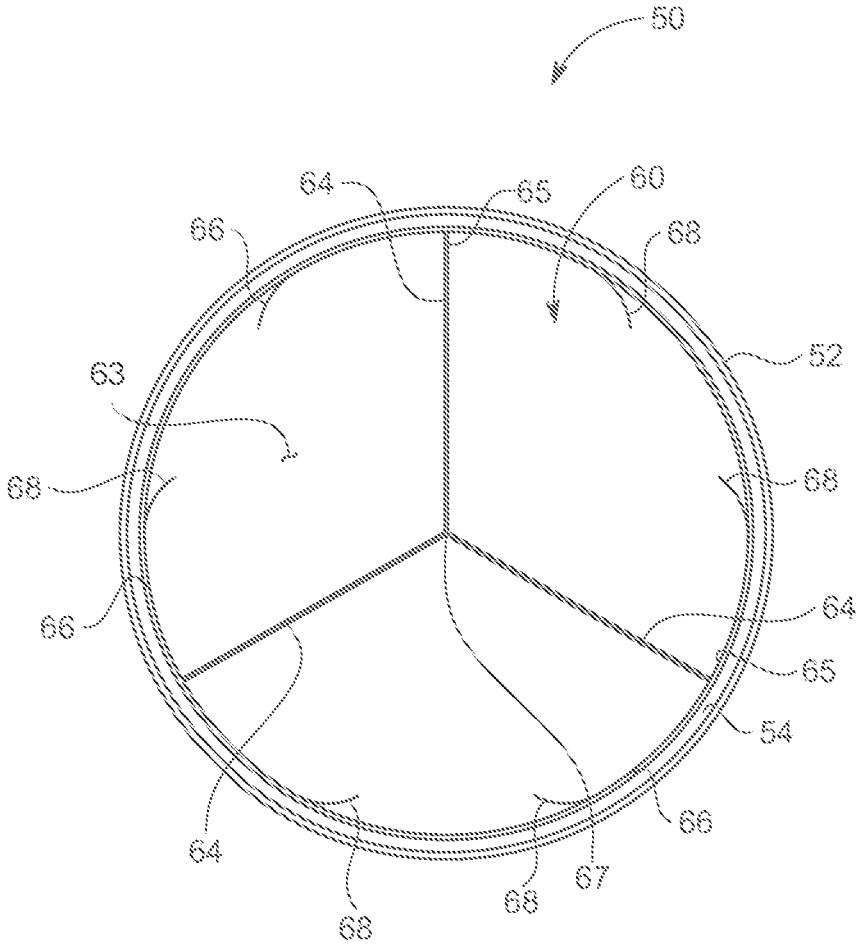
FIG. 5 is an end view of the dome of FIG. 2.

As illustrated in FIGS. 4 and 5, the dome portion 60 includes at least one weakened path extending thereacross so as to permit the dome portion 60 to rupture upon application of a sufficiently high force on the top side thereof. In particular the weakened path may comprise a path extending across the dome portion 60 having a reduced thickness in comparison to the remainder of the dome portion 60 such that the dome portion 60 will break at the predetermined pressure. By way of non-limiting example, the dome portion 60 may have a thickness of between 0.02 and 0.3 inches (0.5 and 8 mm) whereas the weakened path may have a thickness of between 0.01 and 0.2 inches (0.25 and 5 mm). The dome portion 60 of the barrier member 50 may be formed of any suitable material including, by way of non-limiting example, metals, degradable or dissolvable materials, rubber or plastic.

The weakened path may be formed across the dome portion 60 along any path so as to permit the remaining portions of the dome portion 60 to be bent outward to be substantially aligned with the retaining ring 52. In particular, the weakened path may comprise one or more side paths 64 extending from a top centremost portion of the dome portion 60. The side paths 64 divide the dome portion 60 into one or more segments 63 that may be bent outwards. As illustrated in FIGS. 4 and 5, the dome portion 60 may include 3 side paths 64 separating the domed portion into three segments extending from the retaining ring 52 to distal tips. Accordingly, the side paths extend from a proximate end 65 proximate to the retaining ring 52 to interconnecting distal ends 67. The weakened path may also include one or more end paths 66 extending substantially parallel to the retaining ring 52 at the proximate end 65 of the side paths. The separate the edges of each segment 63 from the portion of the dome portion 60 connected to the retaining ring 52 so as to permit those corners proximate to the retaining ring 52 to be deformed as the dome portion 60 is bent into a substantially cylindrical shape around the central bore 38. Optionally the ends 68 of the end portions 66 may be turned back towards the distal ends 67 of the side paths as illustrated in FIGS. 4 and 5.

Figure 6:
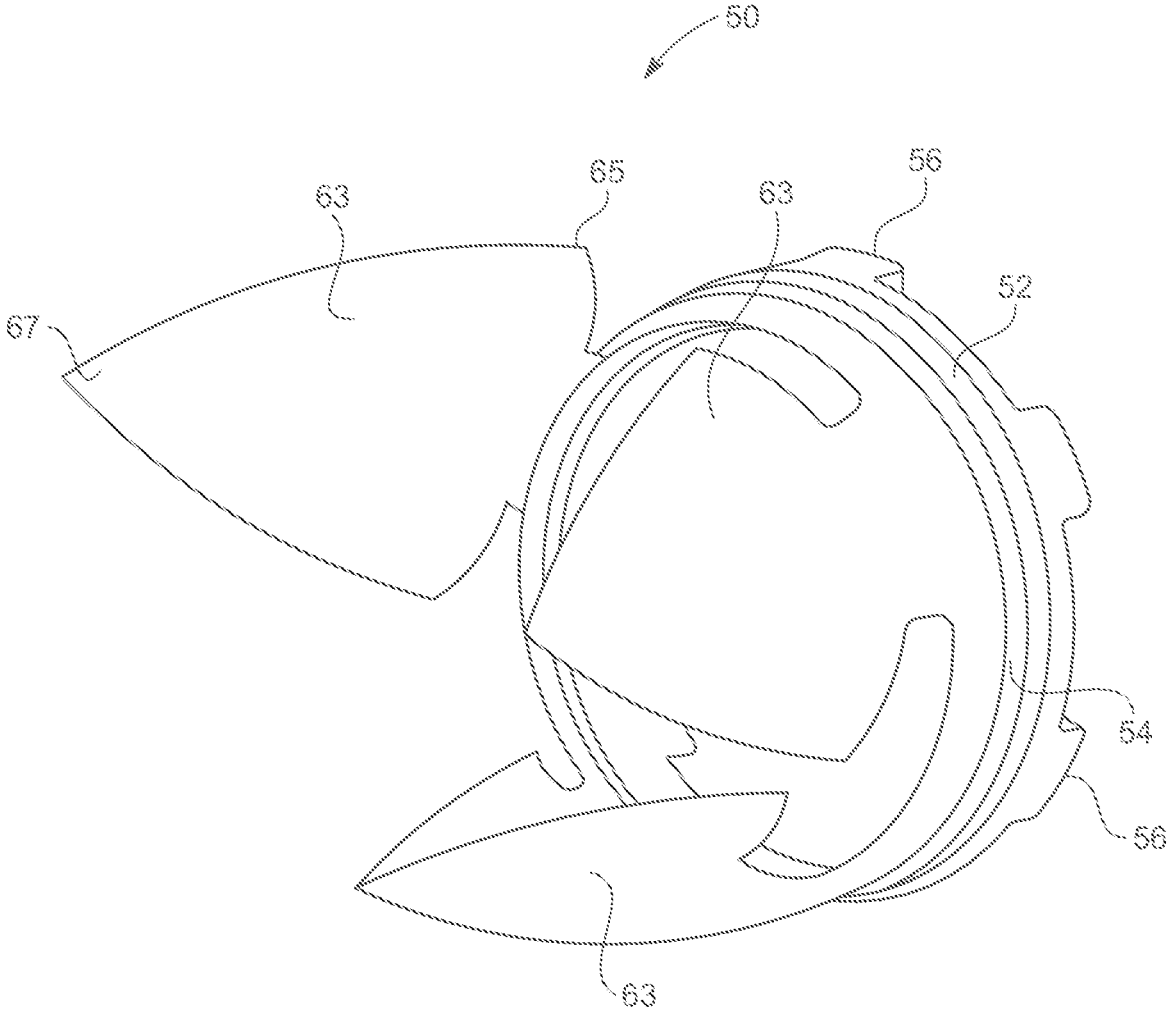
FIG. 6 is an end perspective view of the dome of FIG. 2 at a ruptured configuration.

In operation, upon rupture of the weakened path along the side and end paths 64 and 66, the segments 63 are permitted to rotate outward under pressure from the inside of the dome and/or movement of the optional sleeve 70 as will be more fully described below so as to lie against the inside of the 25 bore 38 of the casing 32 as illustrated in FIG. 6.

Figure 8:
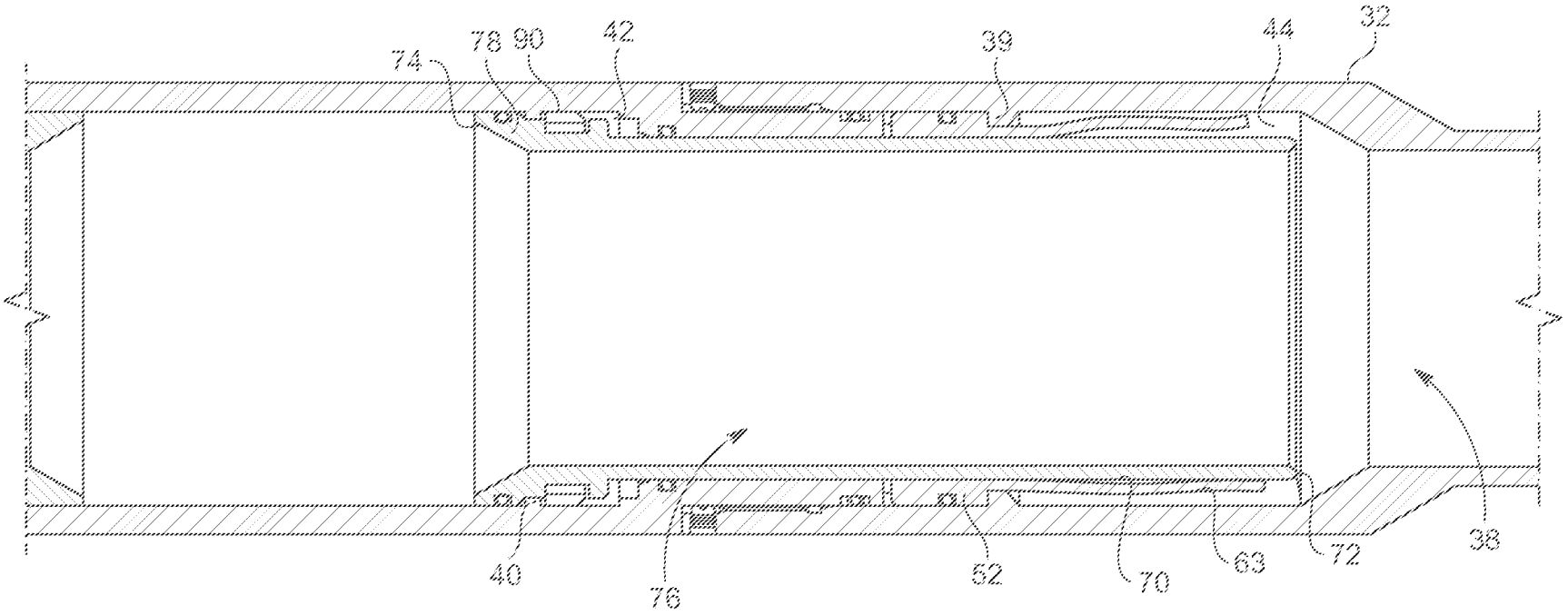
FIG. 8 is a detailed cross sectional view of the apparatus of FIG. 2 as taken along the length of the apparatus at a ruptured configuration.

Optionally, the apparatus 30 will include a slidable sleeve 70 within the bore 38 of the casing 32 upstream of the barrier member 50. The sleeve 70 is retained above the barrier member 50 until a sufficient pressure is achieved within the bore 38 of the casing 32 whereupon the sleeve 70 is shifted downwards engaging upon the inside of the barrier member 50 and aiding its rupture. Optionally, the sleeve 70 may have an initial starting positon in contact with the barrier member 50. After the barrier member 50 is ruptured, the sleeve 70 overlies the segments 63 thereby capturing them within a cavity 44 between the sleeve 70 and the casing 32 as illustrated in FIG. 8.

Figure 7:
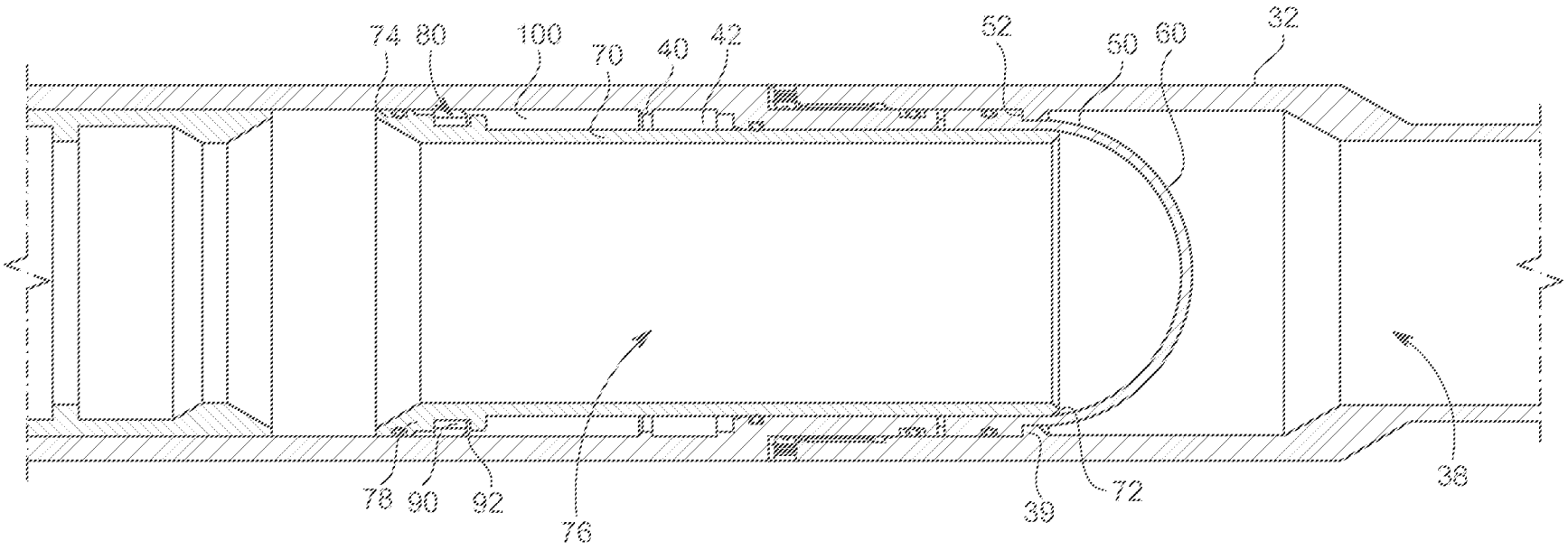
FIG. 7 is a detailed cross sectional view of the apparatus of FIG. 2 as taken along the length of the apparatus at an initial configuration.

Turning now to FIG. 7, the sleeve 70 extends between leading and trailing edges 72 and 74, respectively and forming a central passage 76 therethrough. The central passage 76 is sized to permit liquids, tools and other objects to be passed therethrough and is therefore selected to be substantially similar to the interior of the completion string. The trailing edge 74 includes a widened annular wall 78 having a seal between the annular wall 78 and the casing 32. The annular wall includes an annular groove 80 therein sized to receive an annularly expandable, or snap ring 90 therein. It will be appreciated that other retaining and locking one directional movement devices, including, by way of non-limiting example, ratchets and wedges may also be utilize. The ring 90 may include a chamfered leading edge 92 so as to be radially compressed upon engagement upon a ridge or other surface as the sleeve 70 is moved in a downward direction. As illustrated in FIG. 7, the annular wall forms an annular chamber 100 between the sleeve 70 and the casing. The annular chamber may be sealed at atmospheric pressure or may optionally vented to the annulus of the completion string. It will be appreciated that the annular chamber may also contain any fluid including, by way of non-limiting example, liquids, gasses or air. As illustrated the widened trailing edge 74 of the sleeve formed a larger annular piston area in the central bore 38 than the annular wall 78 forms with the annular chamber 100. Accordingly this difference in annular piston area creates a biasing force towards the barrier member 50 when the bore 38 is pressurized. As set out above, the thickness of the weakened path will be selected to rupture upon a desired pressure within the bore 38. At that time, the sleeve 70 is also biased downward and into the barrier member 50 thereby adding rupturing force thereto. After the barrier member 50 ruptures, the sleeve moves further downward so as to force the segments 63 outward and thereby capture them between the sleeve 70 and the casing 32. In such movement, the chamfered edge 92 of the ring is biased inward as it passes a retaining ridge 40 extending inwardly from the casing. After passing the retaining ridge 40, the ring 90 is permitted to expand outward thereby preventing movement of the sleeve in the upward direction wherein the ring 90 is retained in a locking annular cavity 42.

Figure 9:
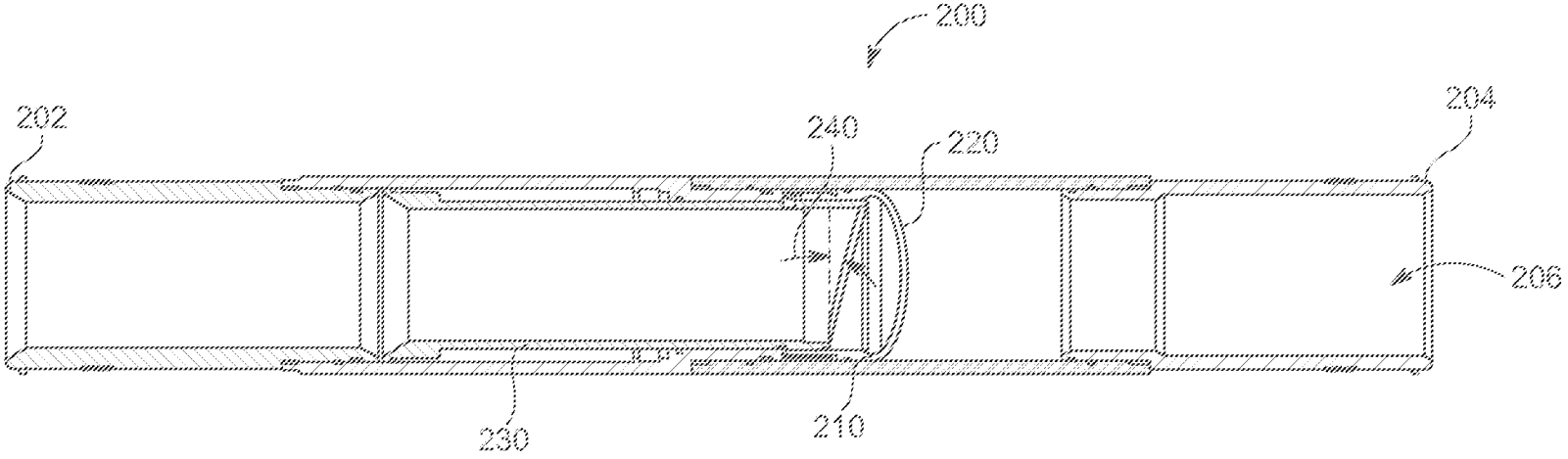
FIG. 9 is a cross sectional view of an apparatus for providing buoyant force to a completion string according to a further embodiment.
Figure 10:
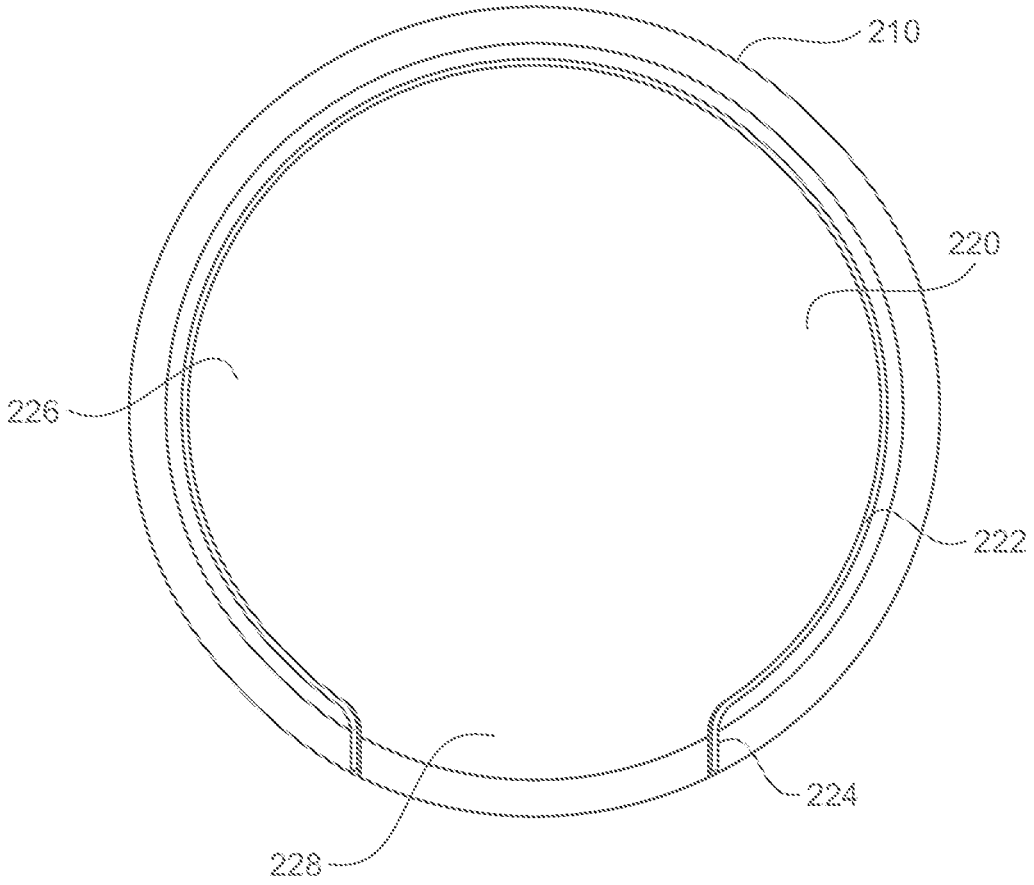
FIG. 10 is an end view of the dome of FIG. 9 at an initial configuration.

Turning now to FIGS. 9 through 12, a further embodiment is illustrated generally at 200. Similar to the above embodiment, the apparatus 200 includes a casing 208 extending between first and second ends 202 and 204, respectively with a passage 206 extending therethrough. A barrier member 210 is located within the passage 206 which includes a dome portion 220. The dome portion 220 may be substantially spherical as shown above or may optionally have a radius greater proximate to the sides as shown in FIG. 9. The dome portion 220 includes a deformable, weakened or thinner path 222 extending around the periphery thereof for a majority of the circumferences. The ends 224 of the weakened path 222 may be oriented towards the edge of the dome portion 220 as shown in FIG. 10 with a hinge portion 228 therebetween. The weakened path 222 defines a flap 226 which may be separated from the remainder of the dome portion 220 as descried below to permit access through the dome portion 220.

Figure 11:
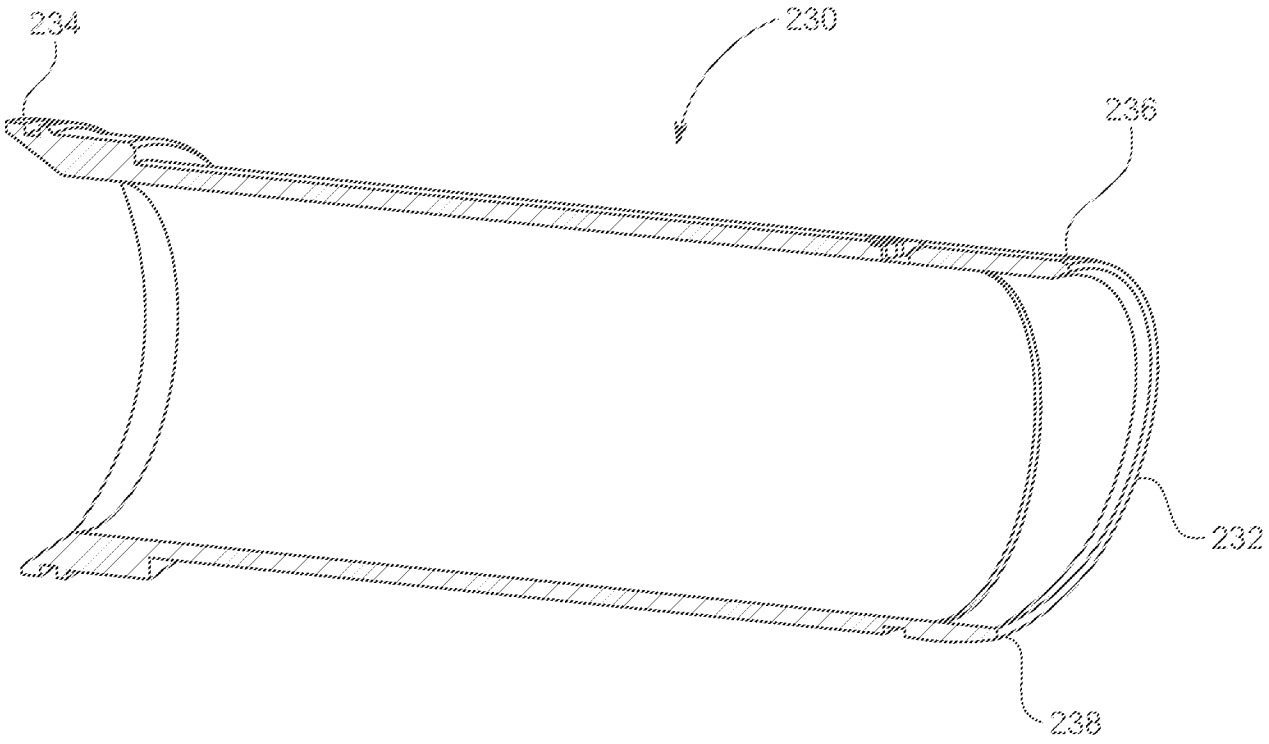
FIG. 11 is perspective view of the sleeve of the apparatus of FIG. 9.
Figure 12:
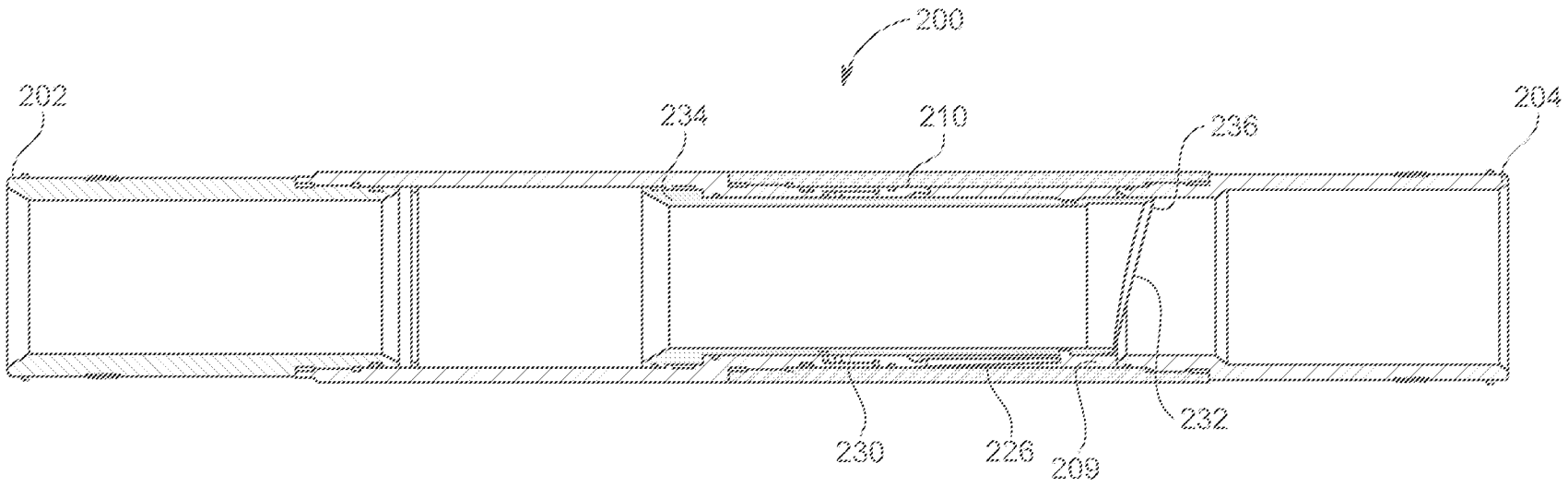
FIG. 12 is a detailed cross sectional view of the apparatus of FIG. 9 as taken along the length of the apparatus at a ruptured configuration.

The apparatus 200 may include a slidable sleeve 230 as set out above extending between leading and trailing edges 232 and 234, respectively. The leading edge 232 has an angled profile along an offset angle generally indicated at 240 in FIG. 9 so as to present a first edge portion 236 further advanced of the second edge portion 238 as shown in FIG. 11. In operation, the leading edge 232 is aligned with the dome portion 220 such that the second edge portion 238 is proximate to the hinge portion 228 and the first edge portion 236 is opposite to the hinge portion 228. In such a manner, the first edge portion 236 will engage the dome portion 220 first and may have a sharpened profile so as to perforate or cut the dome portion 220 starting at the first edge portion 236 and working around to the second edge portion 238. The leading edge 232 may be substantially aligned with the thinned path 222 to aid such separation. As the slidable sleeve 230 is slid forward, the flap 226 will be separated from the remainder of the barrier member 210 and deformed outward along the wall of the casing 208 into an annular cavity 209 between the slidable sleeve 230 and the casing 208 thereby containing it out of the desired flow path through the apparatus'.

While specific embodiments have been described and illustrated, such embodiments should be considered illustrative only and not as limiting the disclosure as construed in accordance with the accompanying claims.

What is claimed is:

1. An apparatus for selectably sealing an interior bore of a down hole string comprising:

an elongate body extending between top and bottom ends having connectors for connecting the body in line with a completion string;

an interior wall forming a bore through the elongate body between top and bottom ends; and a rupturable barrier member fastened to and bridging the bore, the barrier member being deformable so as to permit passage therepast after being ruptured, wherein the rupturable barrier member includes:

a securing portion connectable to the elongate body and a bridging portion extending therefrom operable to enclose the bore in an initial configuration; and at least one weakened path defining at least one leaf portion operable to be separated from a remainder of the barrier member along the weakened path, wherein the weakened path extends from a rupture point to side ends extending adjacent to the securing portion, the side ends defining a hinge portion therebetween narrower than a widest portion of the at least one leaf portion.

2. The apparatus of claim 1 wherein the barrier member is ruptured by exceeding a predetermined pressure within the elongate body at a location above the barrier member.

3. The apparatus of claim 1 wherein the bridging portion comprises a dome-shaped member.

4. The apparatus of claim 3 wherein the dome-shaped member has a constant radius.

5. The apparatus of claim 3 wherein the dome-shaped member has a variable radius.

6. The apparatus of claim 1 wherein the at least one weakened path comprises a path along the bridging portion thinner than a remainder thereof.

7. The apparatus of claim 1 wherein the at least one leaf portion is deformable so as to be operable to be deformed to a shape corresponding to the bore.

8. The apparatus of claim 1 wherein the at least one leaf portion comprises a plurality of leaf portions.

9. The apparatus of claim 1 wherein the barrier member is oriented concavely downward.

10. The apparatus of claim 1 wherein the apparatus further includes a slidable sleeve extending between first and second ends located within the bore upstream of the barrier member.

11. The apparatus of claim 10 wherein the slidable sleeve is biased towards the barrier member by a pressure within the bore.

12. The apparatus of claim 11 wherein the slidable sleeve is adapted to initiate the rupture of the barrier member at a downward location of movement thereof.

13. The apparatus of claim 11 wherein the first end of the sleeve forms a piston operable to be biased towards the second end under pressure within the bore.

14. The apparatus of claim 13 wherein the sleeve forms an annular cavity with the elongate body proximate to the first end.

15. The apparatus of claim 14 wherein the annular cavity contains a fluid at atmospheric pressure at an initial or run in condition.

16. The apparatus of claim 10 wherein the slidable sleeve is retained at an initial position by a shearable member until a predetermined pressure is applied to the bore.

17. The apparatus of claim 10 wherein the slidable sleeve is oriented radially within the elongate body to engage the barrier member at a location thereon selected to correspond to an initial rupture location of the barrier member.

18. The apparatus of claim 10 wherein the slidable sleeve forms a void with the sleeve downstream of the barrier member sized to retain the barrier member after rupturing thereof.

19. The apparatus of claim 10 wherein the slidable sleeve includes a selectably engageable retaining member to engage a shoulder in the bore so as to retain the slidable sleeve at a position containing the at least one leaf portion in the void.

20. The apparatus of claim 19 wherein the selectably engageable retaining member comprises a snap ring.

21. The apparatus of claim 10 wherein the second end slidable sleeve includes an angled leading edge to a lead portion.

22. The apparatus of claim 21 wherein the leading edge is opposite to a hinge portion of the barrier member.

23. The apparatus of claim 21 wherein the second end is sharpened.

24. The apparatus of claim 21 wherein the lead portion is aligned with a weakened path in the barrier member.

25. The apparatus of claim 24 wherein a thickness of the weakened path is selected to prevent the leading edge from penetrating therethrough until a predetermined pressure has been introduced to the bore.

26. The apparatus of claim 10 wherein the slidable sleeve includes a longitudinal bore therethrough having a diameter corresponding substantially to the bore in the elongate body upstream and downstream of the slidable sleeve.

27. A method for selectably sealing an interior bore of a down hole string comprising:

locating an elongate body extending between top and bottom ends in line with a completion string; and applying a pressure to a bore through the completion string and body so as to rupture a barrier member fastened to and bridging the bore into at least one leaf portion, wherein the at least one leaf portion is deformed out of the path of the bore along a weakened path defining at least one leaf portion operable to be separated from the remainder of the barrier member along the weakened path, wherein the weakened path extends from a rupture point to side ends extending adjacent to a securing portion of the barrier member, the side ends defining a hinge portion therebetween narrower than the widest portion of the at least one leaf portion.

* * * * *